US005952953A

United States Patent [19]

Nikawa et al.

[11] Patent Number: 5,952,953

[45] Date of Patent: Sep. 14, 1999

[54] WAVE ABSORBER

[75] Inventors: Yoshio Nikawa, 884-1, Kamikuratacho, Totsuka-Ku, Yokohama-shi; Masaru Chino, 2-3, Hayashi-1-chome, Yokosuka-shi; Shinichi Kitahata, Toride; Keiko Kurata, Tsukuba, all of Japan

[73] Assignees: Hitachi Maxell, Ltd.; Yoshio Nikawa; Masaru Chino, all of Osaka, Japan

[21] Appl. No.: 09/041,729

[22] Filed: Mar. 13, 1998

[30] Foreign Application Priority Data

Mar. 14, 1997 [JP] Japan ..... 9-082094

[51] Int. Cl.[6] ..... H01Q 17/00

[52] U.S. Cl. ..... 342/1

[58] Field of Search ..... 342/1–4

[56] References Cited

U.S. PATENT DOCUMENTS 3,568,195 3/1971 Wesch ..... 342/1

3,721,982 3/1973 Wesch ..... 342/1

*Primary Examiner*—Daniel T. Pihulic

*Attorney, Agent, or Firm*—Birch, Stewart, Kolasch & Birch, LLP

[57] ABSTRACT

A wave absorber which is light in weight, rich in flexibility and excellent in wave absorption characteristics in a microwave frequency range. The wave absorber in which composite carbon black particles including crystalline graphite and amorphous carbon black are dispersed into an insulating matrix. In the wave absorber, dispersion of the composite carbon black particles is adjusted so that a ratio (ρ/R) of a volume resistivity ρ measured at frequencies of 30, 100 and 500 kHz to a measured DC volume resistivity R is in a predetermined range and a volume ratio of the composite carbon black particles having particle diameters of 10 nm to 200 nm to all the composite carbon black particles is in a range of 5% to 95%. Thereby, a wave absorber excellent in absorption characteristics is obtained.

6 Claims, 2 Drawing Sheets

FREQUENCY CHARACTERISTICS SHOWING RELATIONSHIPS BETWEEN COMPLEX SPECIFIC DIELECTRIC CONSTANT OF SAMPLES OBTAINED IN AN EXAMPLE 4 AND FREQUENCY

FREQUENCY CHARACTERISTICS SHOWING RELATIONSHIPS BETWEEN COMPLEX SPECIFIC DIELECTRIC CONSTANT OF SAMPLES OBTAINED IN AN EXAMPLE 4 AND FREQUENCY

EXAMPLS OF REFLECTION ATTENUATION CHARACTERISTICS OF WAVE ABSORBER SAMPLES OBTAINED IN AN EXAPLE 4 (NUMBERAL VALUES GIVEN IN THE DRAWING DENOTES THICKNESSES OF THE SAMPLES)

WAVE ABSORBER

BACKGROUND OF THE INVENTION

The present invention relates to a light-weight, flexible wave absorber which is used for evaluation of electromagnetic wave radiation characteristics of an electronic device or for prevention or suppression of electromagnetic interference in the electronic device. More particularly, the present invention concerns a wave absorber which is characterized in that primary particles of composite carbon black particles are dispersed into an insulating matrix.

As the number of apparatuses based on electronics increases, troubles caused by electromagnetic noise generated from these apparatuses have been recently increasingly reported. An RF anechoic box for use in accurate evaluation of electromagnetic waves emitted from these apparatuses or for the purpose of attenuating unnecessary electromagnetic waves radiated from electronic apparatuses, an electromagnetic absorption panel has been developed.

Well known examples include a ferrite tile which has a radio wave absorptivity and is provided on a wall of a high-rise building for the purpose of TV ghost phenomenon prevention. There has also been developed a radio wave absorbing board for the purpose of suppressing an error in a radio LAN for radio data transfer in a room or of avoiding wiretapping. Further as an RF anechoic room for evaluation of radio waves emitted from a radio apparatus, there has been used a radio wave absorber which is made of carbon black impregnated into foamed urethane.

However, such ferrite tile or radio wave absorbing board can be applied only to building materials or the like, because it is large in specific gravity and cannot be bent. Such radio wave absorbing panel, that is made of ferrite or carbonyl iron dispersed into rubber synthetic resin, is problematic in that a lot of ferrite and carbonyl iron is filled into the rubber of synthetic resin as a base material because of its large specific gravity. Therefore, the panel tends to be very fragile, so the panel cannot be used for a curved surface or interior of an electronic apparatus.

A tile made of carbon black dispersed into rubber or synthetic resin is lighter in weight and more flexible than a tile made of ferrite or carbonyl iron dispersed into rubber or synthetic resin. However, the former tile has an operable frequency band having a central X band (of 8 to 12.5 GHz). For this reason, when the aforementioned tile is employed for mobile communication devices which have been rapidly popular in these years, it fails, in current circumstances, to provide sufficient characteristics for the devices employing their L (1 to 2 GHz) or S (2 to 4 GHz) band.

SUMMARY OF THE INVENTION

It is therefore an object of the present invention to provide a wave absorber which is light in weight and flexible and has excellent electromagnetic wave absorption characteristics in a wide band range.

The above problem is solved by providing a wave absorber in which composite carbon black particles including crystalline graphite and amorphous carbon black are dispersed into an insulating matrix, and in which a measured DC volume resistivity is in a range of $1\times10^2$ Ω·cm to $1\times10^5$ Ω·cm and ratios (ρ/R) of volume resistivities $\rho_{30}$, $\rho_{100}$ and ρ500 measured at frequencies of 30 kHz, 100 kHz and 500 kHz to a measured DC volume resistivity R are controlled to be within a specific range.

In the wave absorber in which composite carbon black particles including crystalline graphite and amorphous carbon black are dispersed into an insulating matrix, when particle diameters of the composite carbon black particles are measured by an X-ray small-angle scattering method, it is preferable that a volume ratio of the composite carbon black particles having particle diameters of 10 nm to 200 nm to all the composite carbon black particles be in a range of 5% to 95%.

In accordance with the present invention, there is provided a light-weight, flexible wave absorber which exhibits an excellent wave absorption performance in a microwave frequency range.

The wave absorber of the present invention is includes carbon black dispersed into the insulating matrix. The insulating matrix is made of mainly an organic polymer which has sufficient intensity, heat resistance and molding property for its applications. Materials usable as the organic polymer is, for example, an elastomer such as chloroprene rubber, acrylonitrile-butadiene rubber, styrene-butadiene rubber or natural rubber, polyolefin resin, vinylidene chloride resin, polyamide resin, polyether ketone resin, polyvinyl chloride resin, polyester resin, alkyd resin, phenol resin, epoxy resin, acrylic resin, urethane resin, silicone resin, cellulosic resin, vinyl acetate resin, polycarbonate resin; and a mixture thereof may be used as necessary. And if necessary, solvent, dispersant, platicizer, cross-linking agent, age resistor or vulcanization accelerator may be added.

The word "insulating matrix" used in the present invention means a substance which is preferably used as an insulator having a small εr" when real and imaginary parts of the complex specific dielectric constant of the substance at a target electromagnetic frequency are denoted by εr' and εr" respectively. An organic polymer as mentioned above is typical, but organic or inorganic substance other than the above or composite material thereof can be used without any trouble.

Explanation will next be made as to the dispersion form of carbon black. In general, carbon black is often added to rubber, plastic or the like for the purpose of applying electric conductivity thereto, since that carbon black has a large electric conductive property and a large specific surface area. It is well known that an antistatic sheet manufactured for the same purpose as the above or an electrically conductive sheet for electrical shielding is widely used.

In such a sheet, carbon black particles are dispersed into an insulating matrix so as not to lose its electrical conductive property. When an electromagnetic wave is irradiated on such a sheet, the sheet behaves in the same manner as a metallic plate with respect to the electromagnetic wave. Therefore, the sheet reflects the electromagnetic wave. When the sheet is made of carbon black dispersed into the insulating matrix in order to use it as a wave absorber, the sheet can be used as the wave absorber only if the sheet has a proper tanδ (tanδ=εr"/εr') for a target frequency.

The inventor of the present application has paid attention to the fact that, even when an identical type of carbon black is contained in the insulating matrix by an identical amount, its characteristics vary largely depending on its manufacturing method. This is because the dispersion form of carbon black dispersed into the insulating matrix becomes different, which appears as a difference in response characteristics to the electromagnetic wave. For this reason, it is difficult to determine characteristics of the wave absorber only on the basis of the used material and content. The characteristics have not been sufficiently grasped if the dispersion form is unclear.

As a means for examining the dispersion form of carbon black particles, a method for examining the dispersion form based on scanning electron microscope (SEM) observation cannot quantitatively estimate the dispersion form of carbon black, because it is difficult for the method to eliminate the influences caused by overlapped particles. The inventors of the present application have evaluated samples with respect to their volume resistivity. The inventors have conducted not only DC measurement but also AC measurement to examine relationships between volume resistivities and wave absorption characteristics of many samples. As a result, the inventors have found that the wave absorption characteristics can be expressed in terms of ratios (ρ/R) of volume resistivities $\rho_{30}$, $\rho_{100}$ and $\rho_{500}$ at frequencies of 30 kHz, 100 kHz and 500 kHz to a measured DC volume resistivity R.

More specifically, the inventors have found that, when R is in a range of $1\times10^2$ Ω·cm to $1\times10^5$ Ω·cm and a ratio ($\rho_{30}$/R) of $\rho_{30}$ to R is in a range of 0.2 to 0.8, or when R is in a range of $1\times10^2$ Ω·cm to $1\times10^5$ Ω·cm and a ratio ($\rho_{100}$/R) of $D_{100}$ to R is in a range of 0.05 to 0.4, or when R is in a range of $1\times10^2$ Ω·cm to $1\times10^5$ Ω·cm and a ratio ($\rho_{500}$/R) of $\rho_{500}$ to R is in a range of 0.03 to 0.3; an excellent wave absorber can be obtained.

With respect to a relationship between the dispersion form and electrical resistance of carbon black, it is already known that, in general, when carbon black particles have large particle diameters and are sparsely scattered in a matrix, the electric resistance is high. However, when carbon black particles are made fine, the resistance tends to decrease. Furthermore, when carbon black particles are made even finer, the resistance tends to increase inversely. It is impossible to determine the dispersion form of carbon black directly with use of volume resistivity and we failed to completely clarify a wave absorption mechanism in the wave absorber using carbon black. However, it is considered that the dielectric property of the absorber in its microwave range is influenced by the property of an electrical conductor measured at a low frequency. For this reason, as in the present invention, the volume resistivity is made associated with the wave absorption characteristic in the microwave range.

An X-ray small-angle method is a known means for evaluating the dispersion form other than the resistivity method. The X-ray small-angle can determine the states of the size, shape, dispersion and aggregation of different sorts of fine particles of several hundreds of angstroms dispersed into a solid or solution. This method is featured in that, in the case of the wave absorber of the present invention, the method can quantitatively evaluate the density distribution of a sample with respect to an X ray. The size and volume ratio of specific composite carbon black particles in the sample, by irradiating the X ray on the wave absorber sample to analyze an X ray scattered by the sample. In general, a particle diameter range detectable by the X-ray small-angle scattering method is from about 2 nm to about 300 nm.

In the case of the wave absorber of the present invention, it has been confirmed that, when a volume ratio of composite carbon black particles in a particle diameter range of 10 nm to 200 nm to all the composite carbon black particles is in a range of 5 to 95%, the wave absorber can exhibit excellent wave absorption characteristics. Composite carbon black particles in the particle diameter range of 10 nm to 200 nm include both independent and aggregated particles.

In any range other than the above range, the wave absorber cannot have a preferable dielectric constant range.

A volume ratio of composite carbon black particles having particle diameters of 10 nm to 200 nm measured by the X-ray small-angle scattering method with respect to all the composite carbon black particles is preferably in a range of 20 to 70% and more preferably in a range of 40 to 60%.

Explanation will next made as to the carbon black used in the present invention. The carbon black used in the present invention is made of composite carbon black particles including crystalline graphite and amorphous carbon black. The composite carbon black particles are obtained by treating the carbon black at high temperature to crystallize it from its particle surfaces gradually into graphite. For this reason, the carbon black is featured in that, in the process of crystallization from an amorphous state, its volume is decreased and gaps are generally present in the central parts of particles.

Used as a factor of featuring the composite carbon black particles is a crystalline-graphite presence ratio (graphite formation proportion) calculated based on a peak area of (002) plane in an X-ray diffraction diagram. In the present invention, the graphite formation proportion is preferably from 10 to 70%. When carbon black having a graphite formation proportion prescribed within the above range was used, there was obtained a resultant wave absorber which is excellent in absorption characteristics. At present, it is impossible to clearly explain the reason, but it is estimated that, at a graphite formation proportion other than the range of 10 to 70%, the value of tanδ featuring the wave absorber is influenced by both characteristics of the structure of carbon black particles used and the dispersed state of carbon black particles dispersed into the insulating matrix, for which reason the wave absorber failed to have a preferable value of tanδ.

It is desirable that composite carbon black particles for use in the present invention have particle diameters of 10 nm to 10 μm. When the particle diameter is set to be 10 nm or more, the dispersed state of the present invention can be easily realized with use of an existing kneader, dispersing apparatus, etc. When the particle diameter is set to be 10 μm or less, preferable sizes of carbon black can be obtained by grinding or aggregating the particles.

Explanation will then be made as to how to disperse composite carbon black particles of carbon black into the resin.

In order to disperse carbon black into rubber or synthetic resin, a sand mill or the like is usually used when the rubber or resin contains no volatile solvent component. When the rubber or resin contains a volatile solvent component, a ball mill, sand mill or the like is often employed. In the case of use of the roll mill, rubber or synthetic resin is previously kneaded, and a carbon black component is added to the kneaded material for dispersion.

In such a method, even when a strong shearing force is applied to the carbon black, the viscosity of the rubber or synthetic resin component causes no action of the strong shearing force and thus failure of sufficient dispersion thereof. Even when the solvent component is included and dispersion is carried out with use of the ball mill, sand mill or the like, it is practically impossible to realize eventual volatilization of the solvent component and it is difficult to realize a homogeneously dispersed state of carbon black.

One of the dispersing apparatuses usable in the present invention is a kneader which is featured by providing strong compressing and shearing forces. The carbon black component is previously prepared and ground for several minutes. Thereafter, a resin component is added to the ground material by a minimum weight part necessary for obtaining a homogeneous paste of carbon black component to perform initial kneading. In this method, highly high compressing and shearing forces can be applied. Such kneading is carried out for a time duration of from 30 to 2 hours. When the resin component is added by an amount exceeding its necessary level in the initial kneading, the viscosity of the paste decreases and thus necessary compressing and shearing forces cannot be applied. When the resin component is too small in quantity, it is impossible to obtain a homogeneous paste, because uniform compressing and shearing forces cannot be applied to the whole paste. The paste after the completion of the initial kneading is then added with an additional resin component by a suitable means such as a kneader or mixer to prepare paste having a predetermined composition. For the purposes of adding the resin, a general mixer can be employed because it does not require a high shearing force.

If hardener is required, the hardener is added to the paste after the completion of the initial kneading and the hardener-added material is shaped into sheets by a compression roll or pressing machine.

The amount of composite carbon black particles contained in the wave absorber of the present invention can be suitably set according to its target absorption characteristics, but it is suitably from 2 to 20 weight %. When the amount of composite carbon black particles is set to be 2 weight % or more, the wave absorber can be set to have a suitable thickness. When the amount of composite carbon black particles is set to be 20 weight % or less, the dispersion of carbon black can be controlled to a suitable state.

In the case of the wave absorber of the present invention, the central frequency, reflection attenuation and absorption range of its wave absorption characteristics can be adjusted by controlling the graphite formation property and content of composite carbon black particles and the thickness of the shaped member.

The forms of the wave absorber of the present invention include any shape, sheet and painting. They are not limited to the specific forms described above, but may be shaped to various forms as necessary. Further, two of such absorbers may be stacked or such an absorber may be stacked together with another wave absorber or metallic sheet resistor.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
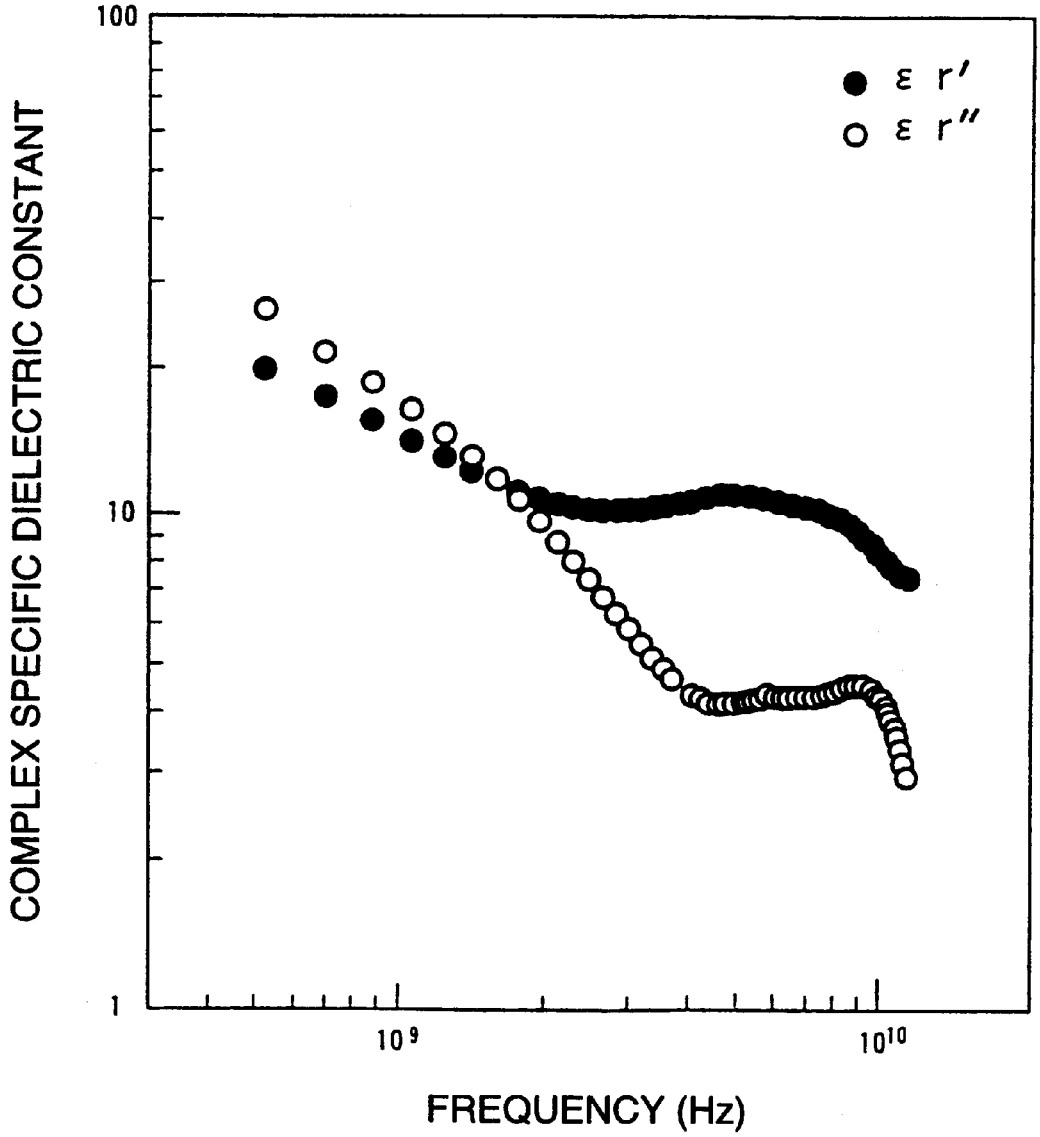
FIG. 1 is a graph showing a relationship between the complex dielectric constant and frequency in a frequency range of 0.5 GHz to 12 GHz in a wave absorber sample obtained from example 4.

The wave absorptivity of a wave absorber in accordance with the present invention will be exemplified in accordance with examples which follow.

In the following examples, volume resistivity was measured with use of an impedance analyzer available in the market. In the present invention, a 4192A LF impedance analyzer (using a 16047A test fixture) manufactured by Hewlett Packard Ltd. was used as the impedance analyzer. Samples were shaped into squares of 1 cm×1 cm and having a thickness of 1 mm. The samples were provided on both sides with electrodes, and then subjected to measurements of resistivities at frequencies to find volume resistivities on the basis of measured resistivities.

Measurements of grain diameter and volume ratio of composite carbon black particles (including both independent and aggregated particles) in each sample were carried out by mounting a small-angle scattering attachment to an X-ray diffraction analyzer (referred to as RINTI 500 and manufactured by Rigaku Denki Ltd.), using a target made of Cu and varying 22 from 0.03 to 5 degrees with an acceleration voltage of 50 kV and a current of 100 mA for X-ray small-angle scattering measurement.

The degree of graphitization of carbon black was found by using the X-ray diffraction analyzer (referred to as RINTI 500 and manufactured by Rigaku Denki Ltd.), using a target made of Cu, varying 22 from 10 to 100 degrees with an acceleration voltage of 50 kV and a current of 100 mA for X-ray small-angle scattering measurement, and calculating the crystalline graphite presence ratio (graphite formation proportion) on the basis of a peak area corresponding to a (002) plane in an obtained diffraction diagram.

EXAMPLE 1

How to prepare a wave absorber will be explained according to its preparing steps.

1. Grinding 6.6 g of composite carbon black particles (having a graphite formation proportion of 31% and an average particle diameter of 30 nm) are placed into a kneader (of a desktop type PBV-01 manufactured by Irie Shokai Ltd.), and the kneader is driven for 10 minutes for grinding.

2. Initial Kneading

The above ground particles are added with silicon resin (base resin TSE3032 prepared by Toshiba Silicon Ltd.) and initially kneaded for 2 hours while the kneader is cooled by water.

3. Secondary Kneading 8.9 g of the obtained initial kneaded material is separated therefrom, added with 50.4 g of silicon resin (base resin TSE303 prepared by Toshiba Silicon Ltd.), and mixed for 30 minutes in the kneader.

4. Addition of Hardening Agent

Next, 45.5 g of the obtained secondary kneaded material is separated therefrom, added with 4.41 g of silicon resin (hardener TSE3032 prepared by Toshiba Silicon Ltd.), and then mixed for 5 minutes in a defoaming mixer.

5. Molding

The obtained kneaded material was heated to a temperature of 120° C. for one minute with use of a test press to obtain a wave absorber having a predetermined thickness.

Through the above steps, there was prepared a wave absorber having a carbon black content of 3.0 weight %.

EXAMPLE 2

A wave absorber having a carbon black content of 3.5 weight % was prepared in the same manner as in the above example 1, except that 8.9 g of initial kneaded material used in the secondary kneading was replaced by 10.3 g of initial kneaded material, 50.4 g of silicon resin in the secondary kneading was replaced by 49.0 g of silicon resin, 45.5 g of secondary kneaded material used in the hardener addition was replaced by 45.6 g of secondary kneaded material, and 4.41 g of silicon resin (hardener) addition was replaced by 4.39 g of secondary kneaded material.

EXAMPLE 3

A wave absorber having a carbon black content of 4.5 weight % was prepared in the same manner as in the above example 1, except that 8.9 g of initial kneaded material used in the secondary kneading was replaced by 13.3 g of initial kneaded material, 50.4 g of silicon resin in the secondary kneading was replaced by 46.10 g of silicon resin, 45.5 g of secondary kneaded material used in the hardener addition was replaced by 45.7 g of secondary kneaded material, and 4.41 g of silicon resin (hardener) addition was replaced by 4.31 g of secondary kneaded material.

EXAMPLE 4

A wave absorber having a carbon black content of 5.0 weight % was prepared in the same manner as in the above example 1, except that 8.9 g of initial kneaded material used in the secondary kneading was replaced by 14.83 g of initial kneaded material, 50.4 g of silicon resin in the secondary kneading was replaced by 44.6 g of silicon resin, 45.5 g of secondary kneaded material used in the hardener addition was replaced by 45.7 g of secondary kneaded material, and 4.41 g of silicon resin (hardener) addition was replaced by 4.32 g of secondary kneaded material.

EXAMPLE 5

A wave absorber having a carbon black content of 8.0 weight % was prepared in the same manner as in the above example 1, except that 8.9 g of initial kneaded material used in the secondary kneading was replaced by 23.6 g of initial kneaded material, 50.4 g of silicon resin in the secondary kneading was replaced by 35.9 g of silicon resin, 45.5 g of secondary kneaded material used in the hardener addition was replaced by 45.8 g of secondary kneaded material, and 4.41 g of silicon resin (hardener) addition was replaced by 4.18 g of secondary kneaded material.

EXAMPLE 6

A wave absorber having a carbon black content of 15.0 weight % was prepared in the same manner as in the above example 1, except that carbon black used in the example 1 was replaced by composite carbon black particles (having a graphite formation proportion of 40% and an average particle diameter of 35 nm), 6.6 g of carbon black used in grinding in the example 1 was replaced by 7.2 g of carbon black, 23.4 g of silicon resin used in the initial kneading was replaced by 22.8 g of silicon resin, 8.9 g of initial kneaded material used in the secondary kneading was replaced by 40.6 g of initial kneaded material, 50.4 g of silicon resin in the secondary kneading was replaced by 19.4 g of silicon resin, 45.5 g of secondary kneaded material used in the hardener addition was replaced by 46.1 g of secondary kneaded material, and 4.41 g of silicon resin (hardener) addition was replaced by 3.86 g of secondary kneaded material.

COMPARATIVE EXAMPLE 1

A wave absorber having a carbon black content of 1.0 weight % was prepared in the same manner as in the above example 1, except that 8.9 g of initial kneaded material used in the secondary kneading was replaced by 3.0 g of initial kneaded material, 50.4 g of silicon resin in the secondary kneading was replaced by 56.2 g of silicon resin addition, and 4.41 g of silicon resin (hardener) addition was replaced by 4.50 g of secondary kneaded material.

COMPARATIVE EXAMPLE 2

Initial kneading was carried out in the same manner as in the example 1, except that 6.6 g of carbon black used in the grinding was replaced by 7.5 g of carbon black and 23.4 g of silicon resin used in the initial kneading was replaced by 20.5 g of silicon resin. The initial kneading was carried out twice. Then 46.6 g of the initial kneaded material was separated therefrom, added with 3.41 g of silicon resin (hardener) and mixed together in the kneader. The obtained kneaded material was molded in the same manner as in the example 1 to prepare a wave absorber having a carbon black content of 25.0 weight %.

COMPARATIVE EXAMPLE 3

Dispersion of carbon black was carried out with use of a roll mill (of a desktop, 3-roll type RMH-1 type manufactured by Irie Shokai Ltd.). First 56.7 g of silicon rubber (TSE221-3U prepared by Toshiba Silicon Ltd.) was kneaded for 30 minutes in the roll mill.

Next 3.0 g of composite carbon black particles (having a graphite formation proportion of 31% and an average particle diameter of 30 nm) was added into the roll mill and kneaded for 2 hours at a temperature of 80° C. The obtained kneaded material was added with 0.28 g of hardener (TC-8 prepared by Toshiba Silicon Ltd.) and then kneaded for 20 minutes. The obtained kneaded material was heated to a temperature of 170° C. for 10 minutes, and further heated for 4 hours at a temperature of 200° C. to prepare a wave absorber having 5.0 weight % of carbon black content.

COMPARATIVE EXAMPLE 4

When the dispersion of carbon black is carried out in the kneader, silicon resin was placed thereinto and then carbon black was added thereinto for kneading. That is, 43.2 g of silicon resin (base resin TSE3032 prepared by Toshiba Silicon Ltd.) was placed into the kneader and the kneader was driven for 10 minutes. Next, composite carbon black particles (having a graphite formation proportion of 31% and an average particle diameter of 30 nm) were added and kneaded for 2 hours.

Subsequently 45.7 g of the obtained kneaded material was added with 4.32 g of silicon resin (hardener TSE3032 prepared by Toshiba Silicon Ltd.) and then mixed in the defoaming mixer. The kneaded material obtained in the same manner as in the example 1 was heated for one minute at a temperature of 120° C. by the test press to prepare a wave absorber having a carbon black content of 5.0 weight %.

COMPARATIVE EXAMPLE 5

A wave absorber having a carbon black content of 5.0 weight % was prepared in the same manner as in the example 1, except that composite carbon black particles (having a graphite formation proportion of 31% and an average particle diameter of 30 nm) was replaced by carbon black particles having a graphite formation proportion of 100% and an average particle diameter of 30 nm, 6.6 g of carbon black used in the grinding was replaced by 9.6 g of carbon black, 23.4 g of silicon resin used in the initial kneading was replaced by 20.4 g of silicon resin, 8.9 g of initial kneaded material used in the secondary kneading was replaced by 10.2 g of initial kneaded material, 50.4 g of silicon resin in the secondary kneading was replaced by 49.2 g of silicon resin, 45.5 g of secondary kneaded material used in the hardener addition was replaced by 45.7 g of secondary kneaded material, and 4.41 g of silicon resin (hardener) addition was replaced by 4.32 g of silicon resin addition.

COMPARATIVE EXAMPLE 6

A wave absorber having a carbon black content of 5.0 weight % was prepared in the same manner as in the example 1, except that composite carbon black particles (having a graphite formation proportion of 31% and an average particle diameter of 30 nm) were replaced by carbon black particles (Valkan XC-72) having a graphite formation proportion of 0% and an average particle diameter of 30 nm, 6.6 g of carbon black used in the grinding was replaced by 5.4 g of carbon black, 23.4 g of silicon resin used in the initial kneading was replaced by 24.6 g of silicon resin, 8.9 g of initial kneaded material used in the secondary kneading was replaced by 18.1 g of initial kneaded material, 50.4 g of silicon resin in the secondary kneading was replaced by 41.3 g of silicon resin, 45.5 g of secondary kneaded material used in the hardener addition was replaced by 45.7 g of secondary kneaded material, and 4.41 g of silicon resin (hardener) addition was replaced by 4.32 g of silicon resin addition.

Samples obtained in the above prepared examples and comparative examples were subjected to measurements of reflection attenuation in a frequency range of 0.05 GHz to 20 GHz with use of a network analyzer (HP8720C manufactured by Hewlett Packard Ltd.).

Table 1 below shows a list of reflection attenuation characteristics of the samples obtained in the examples and comparative examples. Table 2 below also shows measured results of volume resistivities of the samples of the examples and comparative examples. Table 3 below shows measured results of particle diameters and volume ratios of the composite carbon black particles in the samples of the examples and comparative examples.

TABLE 1

| samples | used carbon black graphite formation proportion (%) | carbon black content (weight %) | dispersing apparatus | reflection attenuation characteristics (representative values) center frequency (GHz) | reflection attenuation (dB) | thickness (mm) |
|---|---|---|---|---|---|---|
| example 1 | 31 | 3.0 | kneader | 14 | 30 | 24 |
| example 2 | 31 | 3.5 | kneader | 2.4 | 35 | 11.5 |
| | | | | 0.8 | 40 | 15 |
| example 3 | 31 | 4.5 | kneader | 9.6 | 35 | 2.9 |
| example 4 | 31 | 5.0 | kneader | 6.4 | 31 | 4.2 |
| | | | | 7.8 | 30 | 3.0 |
| | | | | 9.4 | 35 | 2.6 |
| | | | | 10.4 | 34 | 2.0 |
| | | | | 12.0 | 30 | 1.9 |
| | | | | 17.0 | 35 | 1.2 |
| example 5 | 31 | 8.0 | kneader | 6.0 | 40 | 4.0 |
| example 6 | 40 | 15.0 | kneader | 8.0 | 30 | 5.5 |
| comparative example 1 | 31 | 1.0 | kneader | 2.4 | 25 | 60.0 |
| comparative example 2 | 31 | 25.0 | kneader | no absorption | — | — |
| comparative example 3 | 31 | 5.0 | roll mill | no absorption | — | — |
| comparative example 4 | 31 | 5.0 | kneader (previously added with resin) | no absorption | — | — |
| comparative example 5 | 100 | 5.0 | kneader | no absorption | — | — |
| comparative example 6 | 0 | 5.0 | kneader | no absorption | — | — |

TABLE 2

| samples | dispersing apparatus | volume resistivity (Ω · cm) at each frequency measured frequency (Hz) DC R | 30k $\rho_{30}$ | 100k $\rho_{100}$ | 500k $\rho_{500}$ | ratio (ρ/R) of resistivity at each frequency to DC value $\rho_{30}$ | $\rho_{100}$ | $\rho_{500}$ |
|---|---|---|---|---|---|---|---|---|
| ex 1 | kneader | 6750 | 4320 | 1325 | 655 | 0.64 | 0.20 | 0.097 |
| ex 2 | kneader | 11050 | 2460 | 1075 | 410 | 0.22 | 0.097 | 0.037 |
| ex 3 | kneader | 6750 | 1900 | 720 | 400 | 0.28 | 0.11 | 0.059 |
| ex 4 | kneader | 2250 | 1760 | 615 | 130 | 0.78 | 0.27 | 0.058 |
| ex 5 | kneader | 350 | 335 | 147 | 90.3 | 0.96 | 0.42 | 0.26 |
| ex 6 | kneader | 150 | 148 | 93.3 | 42.2 | 0.99 | 0.62 | 0.28 |
| com ex 1 | kneader | $5.01 \times 10^7$ | $1.22 \times 10^7$ | $6.01 \times 10^7$ | 2.25 | 0.24 | 0.12 | 0.045 |
| com ex 2 | kneader | 65 | 62 | 58 | 58 | 0.95 | 0.89 | 0.89 |
| com ex 3 | roll mill | 178 | 177 | 180 | 164 | 0.99 | 1.01 | 0.92 |
| com ex 4 | kneader* | 71 | 69 | 68 | 65 | 0.97 | 0.96 | 0.92 |
| com ex 5 | kneader | $>2 \times 10^7$ | 1105k | 450k | 89k | <0.055 | <0.002 | <0.002 |
| com ex 6 | kneader | $>2 \times 10^7$ | 580k | 241k | 54k | <0.029 | <0.012 | <0.003 |

Notes:
(1) In Table 2, 'ex' stands for example and 'com ex' stands for comparative example, respectively.
(2) In Table 2, 'kneader*' means that resin is previously placed and kneaded in the kneader.

TABLE 3

| sample | volume ratio occupied by particles having sizes of 10 to 200 nm and found by X-ray small-angle scattering measurement volume ratio (%) |
|---|---|
| example 1 | 33 |
| example 2 | 41 |
| example 3 | 44 |
| example 4 | 52 |
| example 5 | 41 |
| example 6 | 48 |
| comparative example 1 | 38 |
| comparative example 2 | 3 |
| comparative example 3 | 4 |
| comparative example 4 | 4 |
| comparative example 5 | 48 |
| comparative example 6 | 73 |

As will be clear from results shown in Table 2, the samples of the present invention have all reflection attenuations of 20 dB or more in a microwave range and exhibit excellent wave absorption characteristics. Meanwhile, the sample of the comparative example 1, which has a carbon black content of 1% as an example, exhibits wave absorption characteristics but is not practical at a central frequency of 2.4 GHz because the sample is as thick as 60 mm. The sample of the comparative example 2, which has carbon black content of 25% as an example, was not able to exhibit wave absorption characteristics in the measured frequency range. The sample of the comparative example 3, which has the same composition as the sample of the example 4, had a DC volume resistivity R of 178 Ω·cm because of use of the roll mill for dispersion. However, the sample is out of the scope of the present invention in its frequency dependency of volume resistivity, and thus failed to exhibit wave absorption characteristics in the measured frequency range even when the sample is used as a wave absorber. The sample of the comparative example 4, which has the same composition as the example of the example 4, corresponds to a case where the addition order of the carbon black and silicon resin at the time of dispersion was inverted, had a measured DC volume resistivity as low as 71 Ω·cm, and failed to exhibit wave absorption characteristics in the measured frequency range. The sample of the comparative example 5, which has the same carbon black content as the sample of the example 4, corresponds to a case where carbon black having a graphite formation proportion of 100% was used, had a measured DC volume resistivity as high as $2\times10^7$ Ω·cm, and failed to exhibit wave absorption characteristics in the measured frequency range. The sample of the comparative example 6, which has the same carbon black content as the sample of the example 4, corresponds to a case where carbon black having a graphite formation proportion of 0%, had a high DC volume resistivity R of $2\times10^7$ Ω·cm or more, and failed to exhibit wave absorption characteristics in the measured frequency range.

With respect to particle diameter and volume ratio, the samples of the examples have all particle diameters of 10 nm to 200 nm and volume ratios of 5% or more. On the other hand, the sample of the comparative example 1 satisfies the conditions of the particle diameter and volume ratio, has a carbon black content of merely 1 weight %, exhibits wave absorption characteristics, but is as too thick as 60 mm and thus impractical. The samples of the comparative examples 2 to 4, which have particle diameters of 10 nm to 200 nm and volume ratios of less than 5%, failed to exhibit wave absorption characteristics. The samples of the comparative examples 5 and 6 satisfy the conditions of particle diameter and volume ratio, correspond to a case where carbon black having carbon formation proportions of 10% and 0% are used, and failed to exhibit wave absorption characteristics in the measured frequency range.

FIG. 1 shows characteristics showing relationships between complex specific dielectric constant and frequency of wave absorbers prepared in the example 4.

The condition where a prepared sheet can be used as a wave absorber is that the wave absorber has an input impedance Zin of 1, where Zin is expressed as follows.

$$Zin = 1 \Big/ \left(\sqrt{\varepsilon_r' - j\varepsilon_r''}\right)\tanh\left\{j(2\pi l/\lambda_o)\left(\sqrt{\varepsilon_r' - j\varepsilon_r''}\right)\right\}$$

where l denotes the thickness of the wave absorber, $\lambda_o$ denotes the wavelength of incident wave, $\epsilon_r'$ and $\epsilon_r''$ denote real and imaginary parts of a complex relative dielectric constant respectively.

The values of $\epsilon_r'$, $\epsilon_r''$ and frequency obtained from FIG. 1 are substituted into the above equation to calculate an optimum thickness of the wave absorber satisfying the condition of Zin=1.

Figure 2:
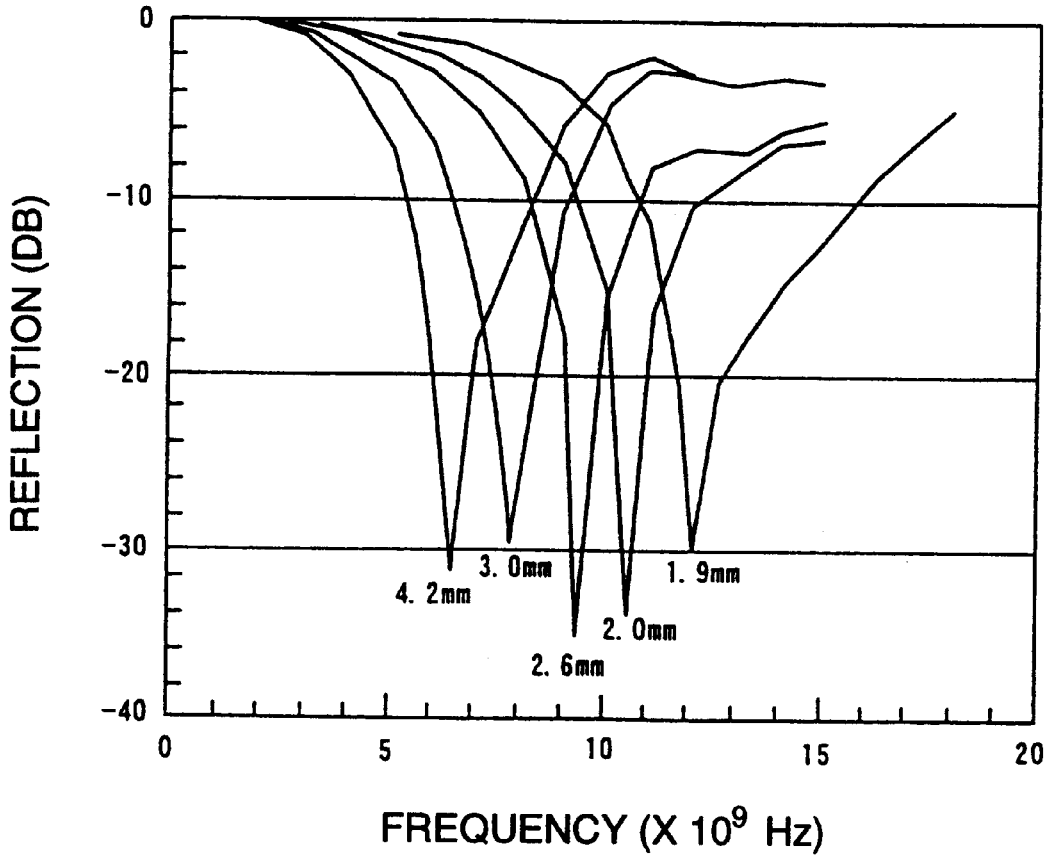
FIG. 2 is a graph showing an exemplary wave absorptivity of the wave absorber sample obtained in example 4.

Based on the results, samples having different thicknesses were prepared. FIG. 2 shows frequency dependencies of reflection attenuation measured for the samples of the different thicknesses. It will be appreciated from the measured results of FIG. 2 that the samples can exhibit excellent attenuation characteristics of maximum 20 dB or more.

As has been explained in the foregoing, in accordance with the present invention, when such flexible resin is added as in the foregoing examples, there can be prepared a light-weight wave absorber which is excellent in flexibility and can be installed even in a location such as a curved surface or the like, unlike the prior art.

The wave absorbers of the present examples are featured by composite carbon black particles including crystalline graphite and amorphous carbon black, dispersed into an insulating matrix. By controlling a volume resistivity within a specific range, there can be realized a flexible and light-weight wave absorber which can be used in a microwave frequency range.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A wave absorber in which composite carbon black particles including crystalline graphite and amorphous carbon black are dispersed into an insulating matrix, wherein a measured DC volume resistivity is in a range of $1\times10^2$ Ω·cm to $1\times10^5$ Ω·cm and a ratio ($\rho_{30}$/R) of a volume resistivity $\rho_{30}$ measured at a frequency of 30 kHz to R is in a range of 0.2 to 0.8.

2. A wave absorber in which composite carbon black particles including crystalline graphite and amorphous carbon black are dispersed into an insulating matrix, wherein a measured DC volume resistivity is in a range of $1\times10^2$ Ω·cm to $1\times10^5$ Ω·cm and a ratio ($\rho_{100}$/R) of a volume resistivity $\rho_{100}$ measured at a frequency of 100 kHz to R is in a range of 0.05 to 0.4.

3. A wave absorber in which composite carbon black particles including crystalline graphite and amorphous carbon black are dispersed into an insulating matrix, wherein a measured DC volume resistivity is in a range of $1\times10^2$ Ω·cm to $1\times10^5$ Ω·cm and a ratio ($\rho_{500}$/R) of a volume resistivity $\rho_{500}$ measured at a frequency of 100 kHz to R is in a range of 0.03 to 0.3.

4. A wave absorber as set forth in claim 1, 2 or 3, wherein said composite carbon black particles have particle diameters of 10 nm to 10 μm and a volume ratio of the composite carbon black particles having particle diameters of 10 nm to 200 nm measured by an X-ray small-angle scattering method to all the composite carbon black particles is in a range of 5 to 95%.

5. A wave absorber as set forth in claims 1, 2 or 3, wherein said composite carbon black particles have a graphite formation proportion of from 10% to 70% found from a peak area ratio of (002) plane in an X-ray diffraction method and said insulating matrix contains 2 to 20 weight % of said composite carbon black particles.

6. A wave absorber as set forth in claim 4 wherein said composite carbon black particles have a graphite formation proportion of from 10% to 70% found from a peak area ratio of (002) plane in an X-ray diffraction method and said insulating matrix contains 2 to 20 weight % of said composite carbon black particles.

* * * * *